US006052864A

United States Patent [19]

Ho

[11] Patent Number: 6,052,864

[45] Date of Patent: Apr. 25, 2000

[54] VACUUM CLEANER WITH RETRACTABLE HANDLE

[75] Inventor: Jen-Hsin Ho, Taipei, Taiwan

[73] Assignee: Airtek Industry Corp., Taipei, Taiwan

[21] Appl. No.: 09/111,324

[22] Filed: Jul. 7, 1998

[51] Int. Cl.[7] ..... A47L 9/32

[52] U.S. Cl. ..... 15/344; 15/144.1; 15/410

[58] Field of Search ..... 15/344, 410, 144.4

[56] References Cited

U.S. PATENT DOCUMENTS

| | | | |
|---|---|---|---|
| 2,660,457 | 11/1953 | Mallon | 15/410 X |
| 4,660,246 | 4/1987 | Duncan et al. | 15/410 X |
| 4,662,026 | 5/1987 | Sumerau et al. | 15/410 X |
| 4,766,638 | 8/1988 | McDowell . | |
| 4,989,295 | 2/1991 | Guhne et al. | 15/410 |
| 5,083,340 | 1/1992 | Takahashi et al. | 15/410 |
| 5,850,667 | 12/1998 | Orsini | 15/410 X |
| 5,867,862 | 2/1999 | Ahlf et al. | 15/410 X |

FOREIGN PATENT DOCUMENTS

| | | | |
|---|---|---|---|
| 286203 | 10/1988 | European Pat. Off. | 15/410 |

*Primary Examiner*—Chris K. Moore

*Attorney, Agent, or Firm*—Akin, Gump, Strauss, Hauer & Feld, L.L.P.

[57] ABSTRACT

A vacuum cleaner includes an elongate housing which has a front end wall defining an air inlet, a rear end wall defining an inserting hole, and a circumferential wall between the front and rear end walls to define a dust collecting chamber. An air impeller is disposed in the housing posterior to the dust collecting chamber to create a vacuum behind the air inlet. A handle includes a handgrip portion and an inserting shaft portion that is disposed to slidably move along a longitudinal guiding way, and that is retractable to be hidden in the elongate housing. The inserting shaft portion has a distal section relative to the handgrip portion. A retaining member is disposed on the circumferential wall adjacent to a rear segment of the guiding way. Two spring-loaded engaging members are respectively disposed in and are radially retractable to position such that the inserting shaft portion in a retracted or pulled-out position. A release actuating member is mounted on the circumferential wall and is depressible externally to release one of the engaging members from the retaining member against the action of the respective engaging member.

5 Claims, 6 Drawing Sheets

VACUUM CLEANER WITH RETRACTABLE HANDLE

BACKGROUND OF THE INVENTION

1. Field of the Invention

The invention relates to a vacuum cleaner, more particularly to a vacuum cleaner with a retractable handle unit.

2. Description of the Related Art

Referring to FIGS. 1 and 2, a conventional vacuum cleaner is shown to include an elongate housing 11, and a handle unit 13. The housing 11 has a front end wall 11F, a rear end wall 11R, and a circumferential wall 11C interposed therebetween to define a dust collecting chamber 111 adapted for accommodating collected dust. The front end wall 11F defines an air inlet orifice communicated with the dust collecting chamber 111. The rear end wall 11R defines an inserting hole 152 on a longitudinal axis that extends from the rear end wall 11R toward the front end wall 11F. An air impeller (not visible) is disposed in the housing 11 and is driven by a motor (not visible) mounted between the dust collecting chamber 111 and the rear end wall 11R to create a vacuum behind the air inlet orifice to collect dust in the dust collecting chamber 11C via the air inlet orifice. A press button 155 is disposed on the circumferntial wall 11C, and includes a spring-biased intermediate portion pivoted on an inner surface of the circumferential wall 11C, a press portion 1551 that extends outwardly of the circumferential wall 11C, and an engaging portion 1542 that extends inwardly into the inserting hole 152 such that, when the handle 13 is inserted into the inserting hole 152, the engaging portion 1542 engages a recess 151 that is formed in an outer surface 131 of the handle 13. Pressing on the press portion 1551 will disengage the engaging portion 1542 from the recess 151.

In order to facilitate storage, the handle 13 is usually detached from the housing 11, thereby consequently resulting in possible misplacement of the handle 13.

SUMMARY OF THE INVENTION

Therefore, the object of this invention is to provide a vacuum cleaner which has a retractable handle incorporated therein so as to overcome the aforementioned disadvantage that is associated with the conventional vacuum cleaner.

Accordingly, a vacuum cleaner of this invention includes an elongate housing, an air impeller, a guiding way, a handle, a retaining member, distal and proximate spring-loaded engaging members, a release actuating member and a biasing member. The housing has front and rear end walls, and a circumferential wall interposed therebetween to define a dust collecting chamber adapted for accommodating collected dust. The front end wall defines an air inlet orifice communicated with the dust collecting chamber. The rear end wall defines an inserting hole substantially on a longitudinal axis which extends from the front end wall to the rear end wall. The air impeller is adapted to be driven by a motor and is mounted in the elongate housing between the dust collecting chamber and the rear end wall to create a vacuum behind the air inlet orifice so that the dust to be collected is entrained in the air sucked by the vacuum through the air inlet orifice. The guiding way is disposed in an inner surface of the circumferential wall along the longitudinal axis, and includes a front segment proximate to the front end wall, and a rear segment. The handle includes a handgrip portion and an inserting shaft portion that is disposed to slidably move along the guiding way, and that is retractable to be hidden in the elongate housing. The inserting shaft portion has a distal section and a proximate section relative to the handgrip portion. The retaining member is disposed on the inner surface of the circumferential wall adjacent to the rear segment of the guiding way. The distal and proximate spring-loaded engaging members 47, 48 are respectively disposed in and are radially retractable relative to the distal and proximate sections of the inserting shaft portion such that, when the proximate spring-loaded engaging member is urged towards and is retained by the retaining member, the inserting shaft portion is in a retracted position. When the distal spring-loaded engaging member is urged towards and is retained by the retaining member, the inserting shaft portion is in a pulled-out position. The release actuating member is mounted on the circumferential wall, and includes a push button that extends outwardly of the circumferential wall so as to be pressed externally, and an actuating portion that is disposed to extend inwardly of the circumferential wall, such that when the push button is pressed, the actuating portion will depress and relieve either one of the distal and proximate spring-loaded engaging members from retention of the respective one of the spring-loaded engaging members. The biasing member is disposed to bias the actuating portion against a pressing action on the push button.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
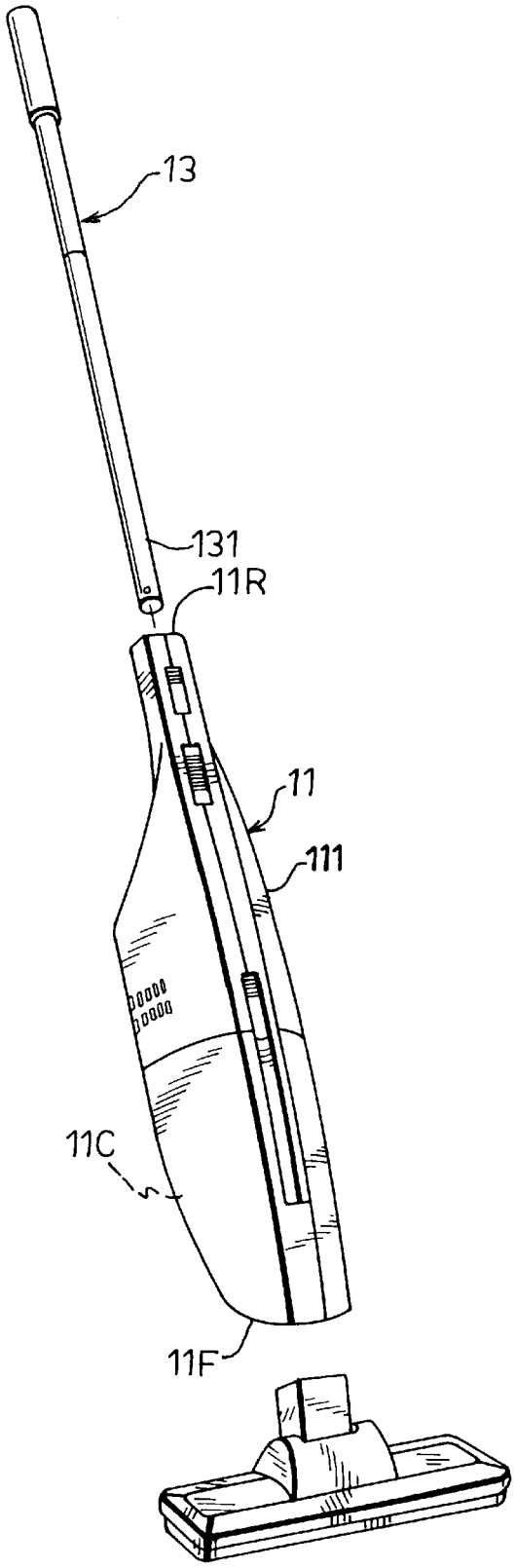
FIG. 1 PRIOR ART
FIG. 1 is a perspective view of a conventional vacuum cleaner.
Figure 2:
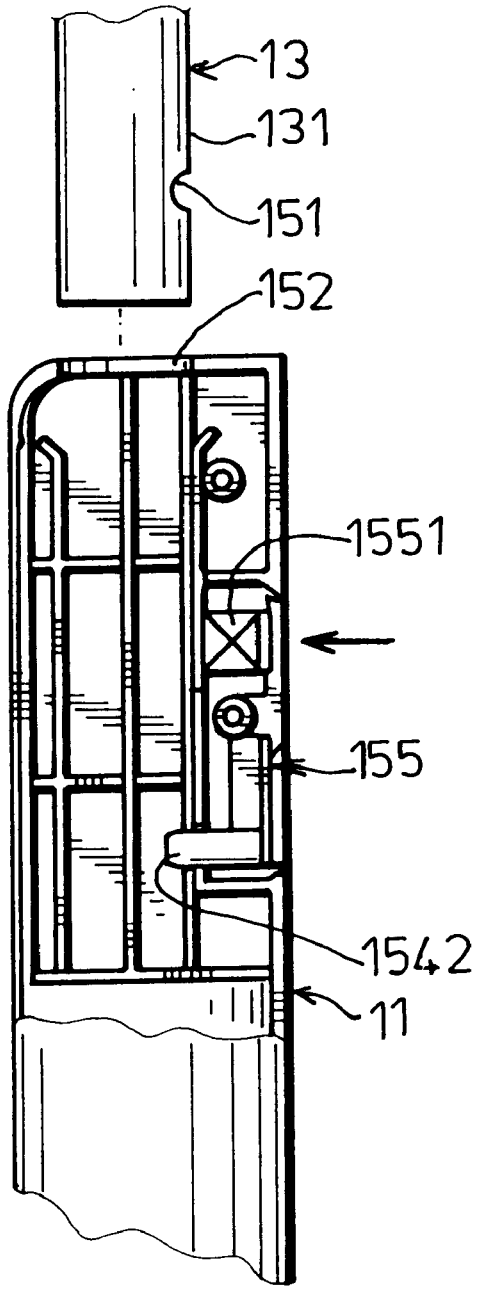
FIG.2 PRIOR ART
FIG. 2 is fragmentary view of the conventional vacuum cleaner.
Figure 3:
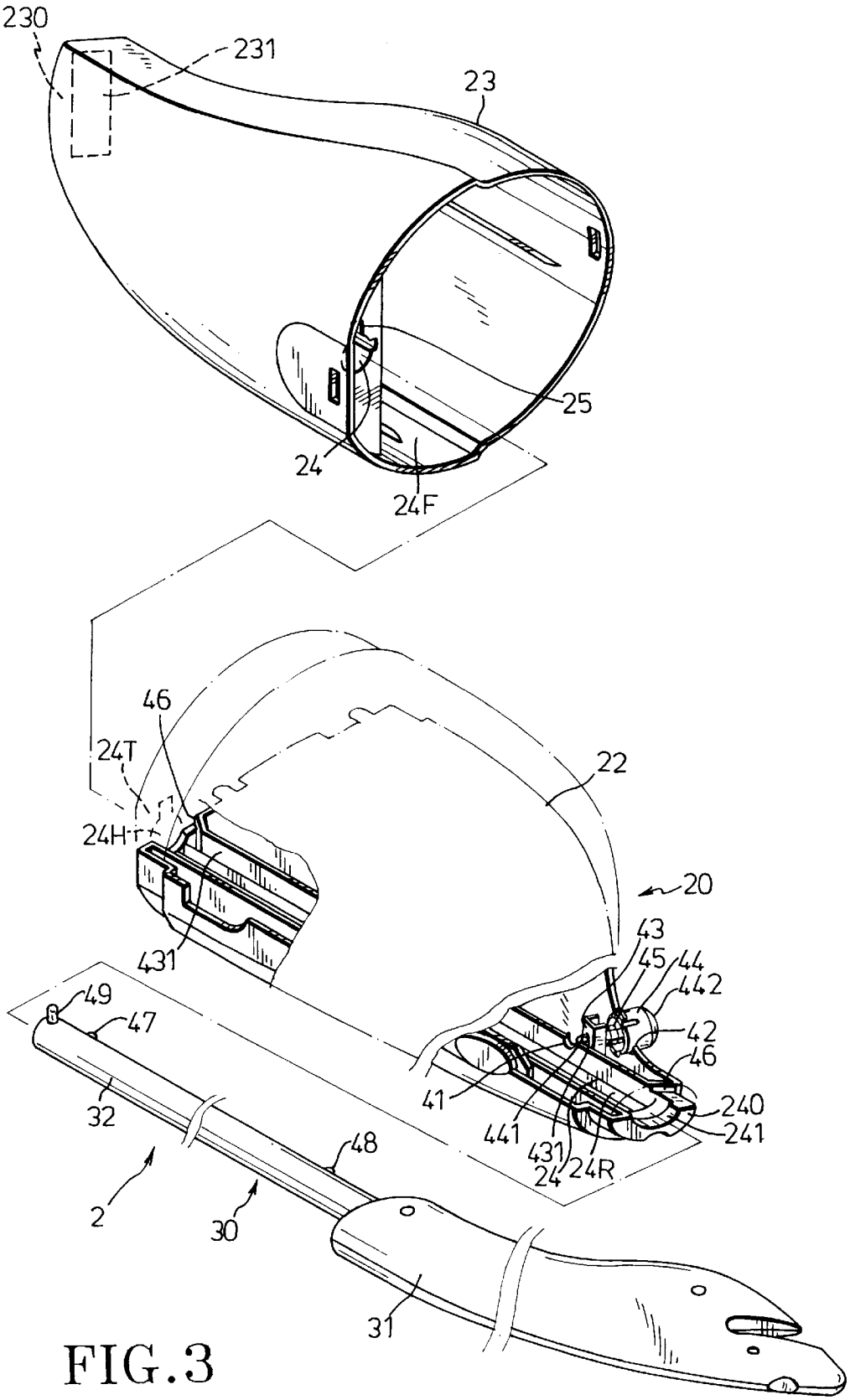
FIG. 3 is an exploded view of a preferred embodiment of a vacuum cleaner according to this invention.
Figure 4:
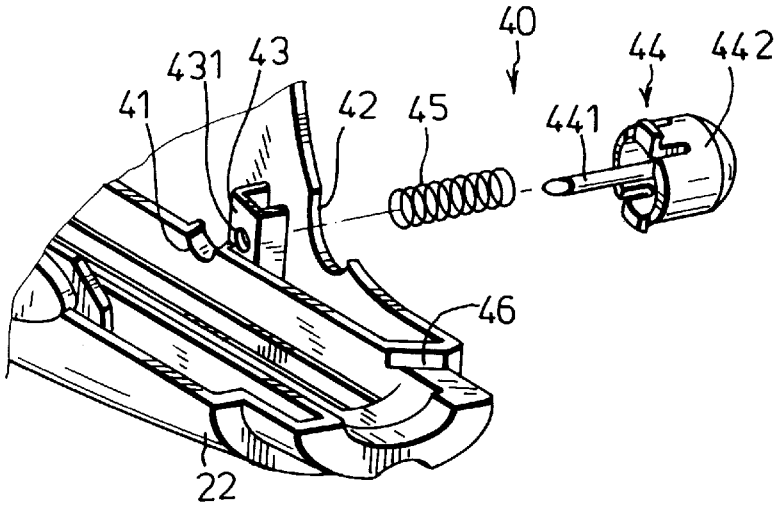
FIG. 4 is a fragmentary perspective view of the preferred embodiment, illustrating how a release actuating member is mounted on a circumferential wall.
Figure 5:
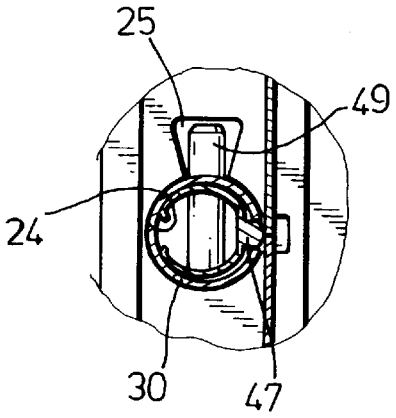
FIGS. 5 and 6 respectively illustrates how a retractable handle is prevented from rotating relative to an elongate housing of the preferred embodiment.

Referring to FIGS. 3, 4, and 5, the preferred embodiment of a vacuum cleaner of this invention is shown to include an elongate housing 20, a guiding way 24, a handle 30, a retaining member 41, distal and proximate spring-loaded engaging members 47, 48, a release actuating member 44, and a biasing member 45.

As illustrated, the housing 20 has a front end wall 230, a rear end wall 240, and a circumferential wall 23 interposed therebetween to define a dust collecting chamber 22 adapted for accommodating collected dust. The front end wall 230 defines an air inlet orifice 231 communicated with the dust collecting chamber 22. The rear end wall 240 defines an inserting hole 241 substantially on a longitudinal axis which extends from the front end wall 230 to the rear end wall 240.

An air impeller (not visible) is adapted to be driven by a motor (not visible) and is mounted in the housing 20 between the dust collecting chamber 22 and the rear end wall 240 to create a vacuum behind the air inlet orifice 231 so that the dust to be collected is entrained in the air sucked by the vacuum through the air inlet orifice 231.

The guiding way 24 is disposed in an inner surface of the circumferential wall 23 along the longitudinal axis, and includes a front segment 24F proximate to the front end wall 230, and a rear segment 24R.

The handle 30 includes a handgrip portion 31 and an inserting shaft portion 32 which is disposed to slidably move along the guiding way 24, and which is retractable to be hidden in the elongate housing 20. The inserting shaft portion 32 has a distal section and a proximate section relative to the handgrip portion 31.

The retaining member 41 is disposed on the inner surface of the circumferential wall 23 and is adjacent to the rear segment 24R of the guiding way 24.

Figure 6:
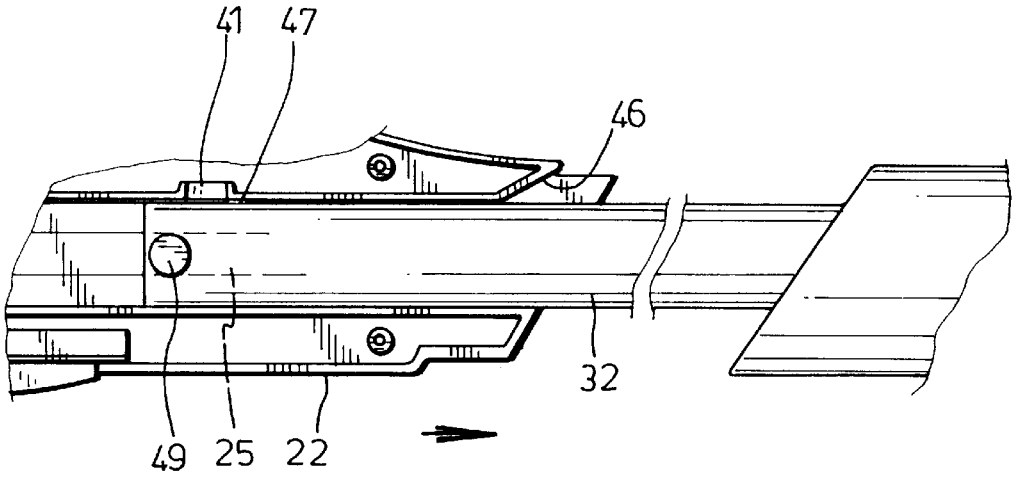
Figure 7:
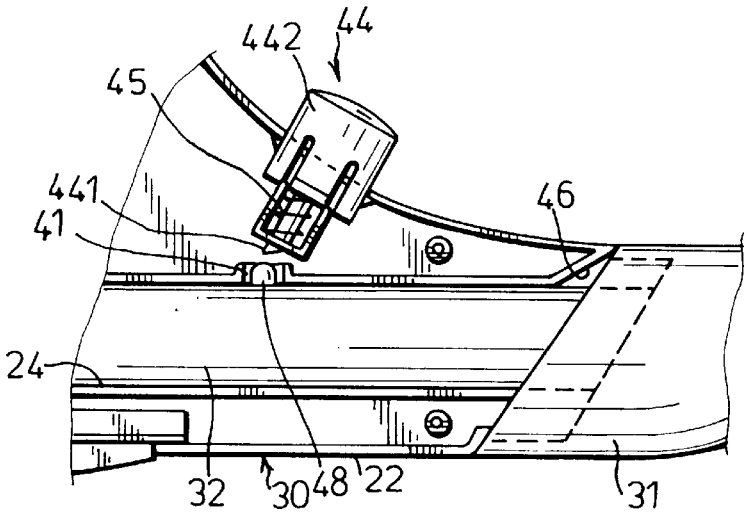
FIGS. 7 and 8 are fragmentary views of the preferred embodiment, respectively illustrating how the retractable handle is pulled outwardly from the elongate housing.

The spring-loaded engaging members 47, 48 are respectively disposed in and are radially retractable relative to the distal and proximate sections of the inserting shaft portion 32 such that, when the proximate spring-loaded engaging member 48 is urged towards and is retained by the retaining member 41, the inserting shaft portion 32 is in a retracted position (see FIG. 6). When the distal spring-loaded engaging member 487 is urged towards and retained by the retaining member 41, the inserting shaft portion 32 is in a pulled-out position, as best shown in FIG. 7.

The release actuating member 44 is mounted on the circumferential wall 23 by the assistance of a mounting post 43, and includes a push button 442 that extends outwardly of the circumferential wall 23 via a hole 42 so as to be pressed externally, and an actuating portion 441 disposed to extend inwardly of the circumferential wall 23 such that, when the push button 442 is pressed, the actuating portion 441 will pass through a hole 431 in the mounting post 43 to depress and relieve either one of the distal and proximate spring-loaded engaging members 47, 48 from retention by the retaining member 41 against action of the respective one of the spring-loaded engaging members 47, 48.

The biasing member 45, in the form of a coil spring, is disposed to bias the actuating portion 441 against a pressing action on the push button 442.

Note that the inserting shaft portion 32 is circular in cross section. The preferred embodiment further includes means for slidably retaining the inserting shaft portion 32 in the guiding way 24 and for preventing rotation of the inserting shaft portion 32 in the guiding way 24 about the longitudinal axis. The front segment 24F of the guiding away 24 includes a transverse wall 24T (see FIG. 3) disposed proximate to the rear segment 24R and formed with a circular hole 24H therethrough for extension of the inserting shaft portion 32 into the front segment 24F. The slidably retaining and rotation preventing means includes an engaging tab 49 which is disposed on and which projects radially from the inserting shaft portion 32 proximate to the distal section, and a radial notch 25 (see FIG. 3) formed in the transverse wall 24T and in communication with the circular hole 24H so as to receive and retain slidably the engaging tab 49 (see FIG. 6).

In the preferred embodiment, the rear segment 24R of the guiding way 24 includes a pair of spaced longitudinal stiffeners 431 which extend in the longitudinal axis to slidably engage the engaging members 47, 48. The retaining member 41 is a circular hole formed through one of the longitudinal stiffeners 431 proximate to the rear end wall 240 such that one of the engaging members 47, 48 is retained therein once the inserting shaft portion 32 is moved to bring said one of the engaging members 47, 48 into alignment with the retaining member 41.

Figure 8:
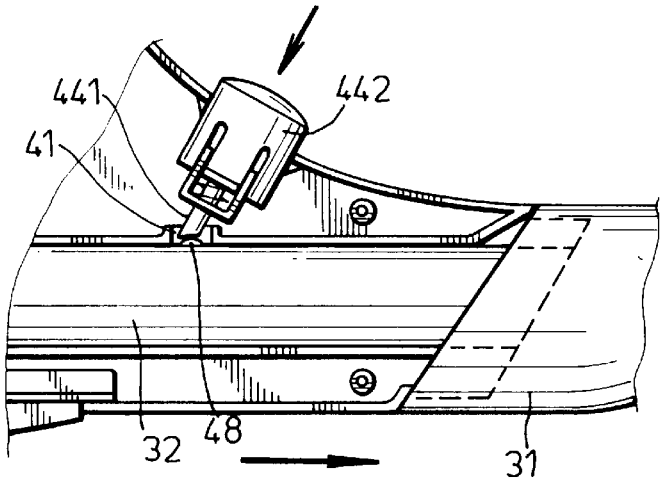
Figure 9:
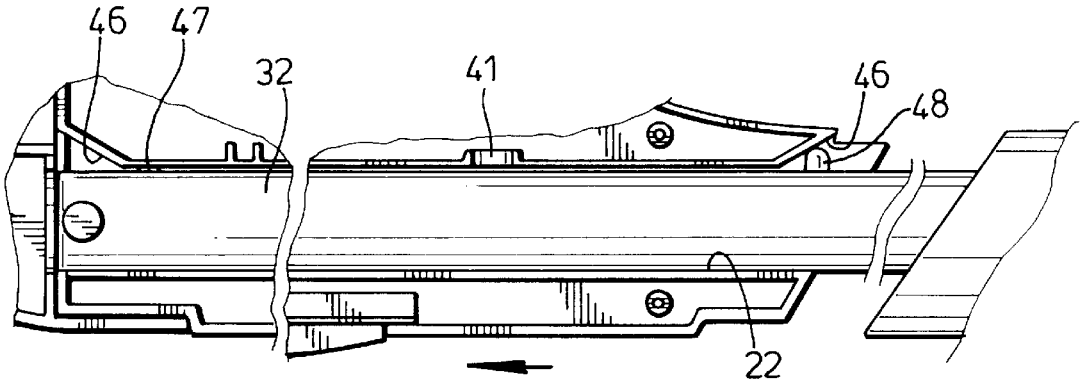
FIG. 9 is a fragmentary view of the preferred embodiment, illustrating how the retractable handle is retracted inwardly into the elongate housing.

The longitudinal stiffeners 431 have two opposite ends which respectively diverge outboard to form front and rear guide members 46 (see FIG. 3) to facilitate sliding movement of a respective one of the engaging members 47, 48 into the rear segment 24R of the guiding way 24, as best shown in FIGS. 8 and 9.

With this invention thus explained, it is apparent that numerous modifications and variations can be made without departing from the scope and spirit of this invention. It is therefore intended that this invention be limited only as indicated in the appended claims.

I claim:

1. A vacuum cleaner comprising:

an elongate housing having a front end wall, a rear end wall, and a circumferential wall interposed therebetween to define a dust collecting chamber adapted for accommodating the collected dust, said front end wall defining an air inlet orifice communicated with said dust collecting chamber, said rear end wall defining an inserting hole substantially on a longitudinal axis which extends from said front end wall to said rear end wall;

an air impeller adapted to be driven by a motor and mounted in said elongate housing between said dust collecting chamber and said rear end wall to create a vacuum behind said air inlet orifice so that the dust to be collected is entrained in the air sucked by the vacuum through said air inlet orifice;

a guiding way disposed in an inner surface of said circumferential wall along said longitudinal axis, and including a front segment proximate to said front end wall, and a rear segment;

a handle including a handgrip portion and an inserting shaft portion which is disposed to slidably move along said guiding way, and which is retractable to be hidden in said elongate housing, said inserting shaft portion having a distal section and a proximate section relative to said handgrip portion;

a retaining member disposed on said inner surface of said circumferential wall and adjacent to said rear segment of said guiding way;

distal and proximate spring-loaded engaging members respectively disposed in and radially retractable relative to said distal and proximate sections of said inserting shaft portion such that, when said proximate spring-loaded engaging member is urged towards and is retained by said retaining member, said inserting shaft portion is in a retracted position, and when said distal spring-loaded engaging member is urged towards and is retained by said retaining member, said inserting shaft portion is in a pulled-out position;

a release actuating member mounted on said circumferential wall, and including a push button which extends outwardly of said circumferential wall so as to be pressed externally, and an actuating portion which is disposed to extend inwardly of said circumferential wall such that, when said push button is pressed, said actuating portion will depress and relieve either one of said distal and proximate spring-loaded engaging members from retention by said retaining member against action of the respective one of said distal and proximate spring-loaded engaging members; and a biasing member disposed to bias said actuating portion against a pressing action on said push button.

2. The vacuum cleaner as defined in claim 1, wherein said inserting shaft portion is circular in cross section, said vacuum cleaner further comprising:

means for slidably retaining said inserting shaft portion in said front segment of said guiding way and for preventing rotation of said inserting shaft portion in said front segment about said longitudinal axis.

3. The vacuum cleaner as defined in claim 2, wherein said front segment of said guiding way includes a transverse wall disposed proximate to said rear segment and formed with a circular hole therethrough for extension of said inserting shaft portion into said front segment, said slidably retaining and rotation preventing means including:

an engaging tab disposed on and projecting radially from said inserting shaft portion proximate to said distal section; and a radial notch formed in said transverse wall and in communication with said circular hole so as to receive and retain slidably said engaging tab.

4. The vacuum cleaner as defined in claim 3, wherein said rear segment of said guiding way includes a pair of spaced longitudinal stiffeners extending in said longitudinal axis to slidably engage said distal and proximate spring-loaded engaging members, said retaining member being a circular hole formed through one of said longitudinal stiffeners proximate to said rear end wall of said elongate housing such that one of said engaging members is retained therein once said inserting shaft portion is moved to bring said one of said engaging members into alignment with said retaining member.

5. The vacuum cleaner as defined in claim 4, wherein said longitudinal stiffeners have two opposite ends which respectively diverges outboard to form front and rear guide members to facilitate sliding movement of a respective one of said engaging members into said rear segment.

* * * * *